United States Patent [19]

Budzich

[11] 4,107,923

[45] Aug. 22, 1978

[54] LOAD RESPONSIVE VALVE ASSEMBLIES

[76] Inventor: Tadeusz Budzich, 80 Murwood Dr., Moreland Hills, Ohio 44022

[21] Appl. No.: 716,360

[22] Filed: Aug. 20, 1976

Related U.S. Application Data

[63] Continuation-in-part of Ser. No. 522,324, Nov. 8, 1974, Pat. No. 3,998,134, and Ser. No. 655,561, Feb. 5, 1976.

[51] Int. Cl.[2] ..... F15B 13/08

[52] U.S. Cl. ..... 60/427; 60/445; 91/412; 91/421; 91/436; 91/446; 137/596.1; 137/596.13

[58] Field of Search ..... 60/427, 445; 91/412, 91/421, 436, 446; 137/596.12, 596.13, 596.1

[56] References Cited

U.S. PATENT DOCUMENTS

| | | | |
|---|---|---|---|
| 3,744,517 | 7/1973 | Budzich | 137/596.1 X |
| 3,807,447 | 4/1977 | Masuda | 137/596.13 |
| 3,984,979 | 10/1976 | Budzich | 60/445 |

*Primary Examiner*—Gerald A. Michalsky

[57] ABSTRACT

A load responsive fluid power multiple load control system using load responsive direction and flow control valves in combination with pump control responding to highest system load. Each direction flow control valve is equipped with a load responsive pressure control which automatically regulates valve inlet pressure to maintain a constant low pressure level at the motor exhaust and a load responsive negative load control to control a constant pressure differential at the motor exhaust. The load responsive control of each direction control valve blocks the pump flow to the motor while controlling negative load, providing the motor inlet with fluid from the motor exhaust.

14 Claims, 2 Drawing Figures

LOAD RESPONSIVE VALVE ASSEMBLIES

This is a continuation in part of application Ser. No. 522,324 filed Nov. 8, 1974, for "Load Responsive Fluid Control Valves", now U.S. Pat. No. 3,998,134, and application Ser. No. 655,561 filed Feb. 5, 1976 for "Load Responsive Fluid Control System".

BACKGROUND OF THE INVENTION

This invention relates generally to load responsive fluid control valves and to fluid power systems incorporating such valves, which systems are supplied by a single fixed or variable displacement pump. Such control valves are equipped with an automatic load responsive control and can be used in a multiple load system, in which a plurality of loads is individually controlled under positive and negative load conditions by separate control valves.

In more particular aspects this invention relates to direction and flow control valves capable of controlling simultaneously a number of loads under both positive and negative load conditions.

In still more particular aspects this invention relates to direction and flow control valves capable of controlling simultaneously multiple positive and negative loads, which while controlling a negative load interrupt pump flow to the motor providing the motor inlet with fluid from the pressurized system exhaust.

Closed center load responsive fluid control valves are very desirable for a number of reasons. They permit load control with reduced power losses and therefore, increased system efficiency and when controlling one load at a time provide a feature of flow control irrespective of the variation in the magnitude of the load. Normally such valves include a load responsive control, which automatically maintains pump discharge pressure at a level higher, by a constant pressure differential, than the pressure required to sustain the load. A variable orifice, introduced between pump and load, varies the flow supplied to the load, each orifice area corresponding to a different flow level, which is maintained constant irrespective of variation in magnitude of the load. The application of such a system is, however, limited by several basic system disadvantages.

Since in this system the variable control orifice is located between the pump and the load, the control signal to a pressure regulating throttling device is at a high pressure level inducing high forces in the control mechanism. Another disadvantage of such a control is that it regulates the flow of fluid into the motor and therefore does not compensate for fluid compressibility and leakage across both motor and valve. Still another disadvantage of such a control is that timing of the valve and sequencing of operations must be very exact to prevent cavitation in the motor and to prevent the motor from being subjected to excessive pressures during control of negative loads. A fluid control valve for such a system is shown in U.S. Pat. No. 3,488,953 issued to Haussler.

Normally the load responsive valve control can maintain a constant pressure differential and therefore constant flow characteristics when operating only one load at a time. With two or more loads, simultaneously controlled, only the highest of the loads will retain the flow control characteristics the speed of actuation of lower loads varying with the change in magnitude of the highest load. This drawback can be overcome in part by the provision of a proportional valve as disclosed in my U.S. Pat. No. 3,470,694 dated Oct. 7, 1969 and also in U.S. Pat. No. 3,455,210 issued to Allen on July 15, 1969. However, while those valves are effective in controlling positive loads they do not retain flow control characteristics when controlling negative loads, which instead of taking, supply the energy to the fluid system and hence the speed of actuation of such a load in a negative load system will vary with the magnitude of the negative load. Especially with so-called overcenter loads, where a positive load may become a negative load, such a valve will lose its speed control characteristics in the negative mode.

This drawback can be overcome by the provision of a load responsive fluid control valve as disclosed in my U.S. Pat. No. 3,744,517 issued July 10, 1973. However, while this valve is effective in controlling both positive and negative loads, with pump pressure responding to the highest pressure of a system load being controlled, it still utilizes a controlling orifice located between the pump and the motor during positive load mode of operation and therefore controls the fluid flow into the fluid motor instead of controlling fluid flow out of the fluid motor.

This drawback can be overcome by provision of load responsive fluid control valves as disclosed in my pending patent application Ser. No. 522,324 filed Nov. 8, 1974, now U.S. Pat. No. 3,998,134, entitled "Load Responsive Fluid Control Valves". However, while such valves maintain the pump discharge pressure higher, by a constant pressure differential, than the highest load pressure of system loads being controlled and are effective in controlling multiple positive loads, while maintaining a relatively constant down stream pressure at the motor exhaust, during control of negative loads those valves supply the motor inlet with throttled down fluid from the pump circuit, therefore using flow from the pump, while controlling a negative load. In certain fluid power control systems it is preferable, while controlling a negative load, to supply fluid to the motor inlet from the motor exhaust circuit instead of using pump capacity.

This drawback can be overcome in part by provision of fluid control valves as disclosed by U.S. Pat. No. 3,807,447 issued to Masuda on Apr. 30, 1974. However, while those valves utilize actuator exhaust fluid for actuator inlet flow requirement when controlling negative loads they regulate actuator inlet pressure by bypassing fluid to a down stream load circuit. Masuda'a valves and their proportional control system are based on series type circuit in which excess fluid flow is successively diverted from one valve to the other and in which loads arranged in series determine the system pressure. In such a system flow to the last valve operating a load must be delivered through all of the bypass sections of all of the other system valves, resulting in higher fluid throttling loss. These valves are not adaptable to simultaneous control of multiple loads in parallel circuit operation since they do not provide system load control pressure signal to the pump flow control mechanism. When used with variable displacement pumps these valves are not capable of providing sufficient pressurized exhaust flow to actuator inlet during control of negative load to prevent cavitation.

SUMMARY OF THE INVENTION

It is therefore a principal object of this invention to provide a load responsive fluid control system in which improved load responsive fluid direction and flow control valves block system pump from motor inlet and supply it with system exhaust flow when controlling negative loads, while transmitting control signals to system pump to maintain the pressure of the system pump higher, by a constant pressure differential, than the highest pressure of the system positive load being controlled.

Another object of this invention is to provide a load responsive fluid control system in which load responsive fluid direction and flow control valves are provided with a pressurized exhaust manifold, flow from which supplies the inlet flow requirements of motors controlling negative loads, the system pump being utilized to prevent pressure in the exhaust manifold dropping below a certain predetermined level.

It is another object of this invention to provide a load responsive fluid control system in which load responsive fluid direction and flow control valves retain their control characteristics during control of positive loads, while responding to a low relatively constant pressure control signal from the outlets of the actuators.

It is a further object of this invention to provide a load responsive fluid control system in which load responsive fluid direction and flow control valves are provided with an interlock, making the negative load control ineffective when the motor is subjected to a positive load.

It is a further object of this invention to provide a load responsive fluid control system in which load responsive fluid direction and flow control valves are provided with positive and negative load controls, the positive load controls having a priority feature permitting control of down stream valves, while the valve with priority feature is not being used.

Briefly the foregoing and other additional objects and advantages of this invention are accomplished by providing a novel load responsive fluid control system for use during proportional simultaneous control of multiple positive and negative loads. A system pump is controlled in respect to a pressure signal transmitted from system valves, corresponding to the highest system load pressure. Exhaust circuit of the system is pressurized, the exhaust flow being used to provide inlet flow requirements of motors controlling negative loads. Valves with a priority feature permit, while inactive, operation of the down stream valves.

Additional objects of this invention will become apparent when referring to the preferred embodiments of the invention as shown in the accompanying drawings and described in the following detailed description.

DESCRIPTION OF THE PREFERRED EMBODIMENTS

Figure 1:
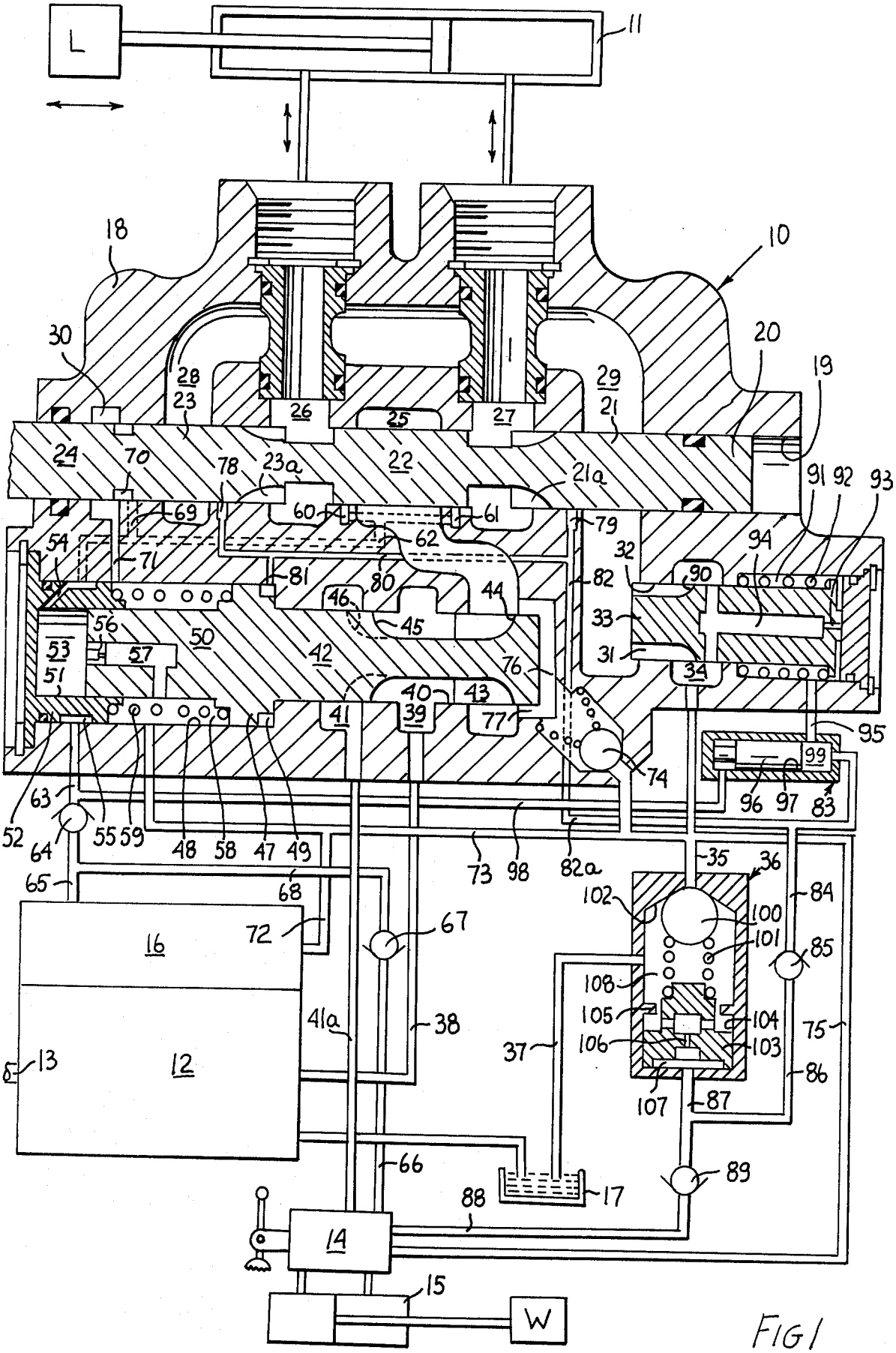
FIG. 1 is a longitudinal sectional view of an embodiment of a flow control valve having a positive load control with priority feature responsive to actuator down stream pressure and control mechanism used in control of negative loads, for use in load responsive fluid control system, with lines, differential pressure relief valve, fixed displacement pump, second load responsive valve, exhaust relief valve, control interlock and system reservoir shown diagramatically.

Referring now to the drawings and for the present to FIG. 1, an embodiment of a flow control valve, generally designated as 10, is shown interposed between a diagramatically shown fluid motor 11 driving a load L and a fixed displacement pump 12 driven through a shaft 13 by a prime mover not shown. Similarly, a flow control valve 14, identical to the flow control valve 10 is interposed between a diagramatically shown fluid motor 15 driving a load W and the pump 12. Fluid flow from the pump 12 to flow control valves 10 and 14 is regulated by a differential pressure relief valve 16 which can be mounted as shown on the pump 12, or be an integral part of the flow control valve 10. If the differential pressure relief valve 16 is made part of the valve assembly it is connected to the fixed displacement pump 12 by a high pressure line capable of transmitting full flow of the pump. The differential pressure relief valve 16, in a well known manner, by bypassing fluid from the pump 12 to a reservoir 17, maintains discharge pressure of the pump 12 at a level, higher by a constant pressure differential, than load pressure developed in fluid motor 11 or 15.

The flow control valve 10 is of a fourway type and has a housing 18 provided with a bore 19, axially guiding a valve spool 20. The valve spool 20 is equipped with lands 21, 22, 23 and 24 which in neutral position of the valve spool 20, as shown in FIG. 1, isolate a fluid supply chamber 25, load chambers 26 and 27, outlet chambers 28 and 29 and an unloading chamber 30. The outlet chamber 29 is cross-connected through passages 31 and a bore 32 guiding a brake spool 33 to an exhaust chamber 34, which in turn is connected through line 35, an exhaust relief valve, generally designated as 36 and line 37 to the reservoir 17.

The pump 12 through its discharge line 38 is connected to a fluid inlet chamber 39. A control bore 40 connects the fluid inlet chamber 39 with the fluid supply chamber 25 and a fluid bypass chamber 41 and axially guides a control spool 42. The control spool 42 through throttling grooves 43 which are provided with cut off edges 44 communicates the inlet chamber 39 with the supply chamber 25 and blocks communication with a throttling edge 45 between the inlet chamber 39 and the bypass chamber 41 in position as shown in FIG. 1. In another configuration of the control spool 42 as shown in dotted lines an edge 46 communicates the inlet chamber 39 with the bypass chamber 41. Land 47 of the control spool 42 slidably engages bore 48 and defines a reaction chamber 49. Stem 50 of control spool 42 slidably engages a bore 51 of a cylinder 52 defining a control chamber 53. The control chamber 53 communicates through passage 54 with annular groove 55 and through a leakage orifice 56 and passage 57 with space 58. A control spring 59 in space 58 biases the control spool 42 towards position as shown in FIG. 1. Positive load sensing ports 60 and 61, located between load chambers 26 and 27 and the supply chamber 25 and blocked in neutral position by land 22, are connected through signal passage 62, annular groove 55, line 63, a check valve 64, and line 65 with the differential pressure relief valve 16. In a similar manner positive load sensing ports of the flow control valve 14 are connected through line 66, a check valve 67 and lines 68 and 65 to the differential pressure relief valve 16. Signal passage 62 is also connected through passage 69 with the bore 19. With valve spool 20 in its neutral position, as shown in FIG. 1, passage 69 is connected through groove 70 with the unloading chamber 30, which in turn is connected by passage 71 with space 58.

Excess pump flow from the differential pressure relief 16 is delivered through line 72 to exhaust line 73 which communicates with space 58, a bypass check valve 74, the exhaust chamber 34 and through line 75 with all of exhaust passages of the flow control valve 14. The bypass check valve 74 is interposed between exhaust line 73 and space 76 which is connected by annular passage 77 with fluid supply chamber 25.

Negative load sensing ports 78 and 79 located between the load chamber 26 and the outlet chamber 28 and the load chamber 27 and the outlet chamber 29 respectively, blocked in neutral position of the valve spool 20 by lands 23 and 21, are connected through passages 80 and 81 with the reaction chamber 49 and through passage 82 and line **82*a* with an interlock, generally designated as 83. Negative load sensing ports 78 and 79 are also connected through line 84, a check valve 85 and lines 86 and 87 with the exhaust relief valve 36. Similarly, negative load sensing ports of the flow control valve 14 are connected through line 88, a check valve 89 to line 87 leading to the exhaust relief valve 36. Flow metering slots 23*a* and 21*a* adjacent to negative load sensing ports 78 and 79 are provided in lands 23 and 21**.

The brake spool 33 axially slidable in the bore 32 is provided with passages 31 which terminate in cut off edges 90. Brake spool 33 projects into space 91 and is biased towards position, as shown in FIG. 1, by a brake spring 92. Space 91 communicates through an orifice 93 and passage 94 with the exhaust chamber 34 and also communicates through line 95 with the interlock 83.

The interlock 83 is provided with a piston 96 slidably guided in a bore 97 which is connected through line 98 with line 63, therefore being connected to the load sensing circuit of the flow control valve 10. In the position, as shown in FIG. 1, the piston 96 of the interlock 83 permits communication between lines 95 and **82*a* through space 99**.

The exhaust relief valve, generally designated as 36, interposed between combined exhaust circuits of flow control valves 10 and 14 which include bypass circuit of the pump 12 and the reservoir 17, is provided with a throttling member 100 biased by a spring 101 towards engagement with a seat 102. The spring 101 is supported by a movable force piston 103 slidably guided in a bore 104 which terminates in stop 105. The force piston 103 is provided with leakage orifice 106 interconnecting space 107 with space 108 which is connected by line 37 with the reservoir 17.

As previously described the differential pressure relief valve 16, in a well known manner, will regulate fluid flow delivered from fixed displacement pump 12 to discharge line 38, by bypassing the fluid flow to line 72 and exhaust line 73, to maintain the pressure in discharge line 38 higher, by a constant pressure differential, than the highest load pressure signal transmitted through the check valve system to the line 65. Therefore with valve spools of flow control valves 10 and 14 in their neutral position blocking positive load sensing ports 60 and 61 and venting signal passage 62 through passage 69, groove 70, the unloading chamber 30, passage 71 and space 58 to exhaust line 73, signal pressure input to the differential pressure relief valve 16 from the line 65 will be at minimum pressure level.

With the fixed displacement pump 12 started up the differential pressure relief valve 16 will bypass through line 72, exhaust line 73, the exhaust relief valve 36 and line 37 all of the pump flow to the system reservoir 17 at minimum pressure level, equivalent to preload in the spring 101, while automatically maintaining pressure in discharge line 38 at a constant pressure, higher by a constant pressure differential, than pressure in line 65, which is equal to minimum pressure in exhaust line 73. Since space 76 is subjected to pump discharge pressure and the control chamber 53 is vented through signal passages 62 and 69 to exhaust pressure in exhaust line 73, control spool 42 is subjected to a constant pressure differential acting on its effective cross-sectional area, thereby generating a force opposing the biasing force of the control spring 59. Subjected to this force control spool 42 will move from right to left compressing the control spring 59. Depending on the selection of the biasing force of the control spring 59 the control spool 42 may be permitted sufficient displacement to interrupt with cut off edge 44 communication between inlet chamber 39 and the supply chamber 25. If control spool 42 is of a priority type having throttling edge 45, throttling edge 45 will move with the control spool 42 from right to left, establishing full flow communication between the inlet chamber 39 and the bypass chamber 41 and therefore connecting fluid under pressure from the pump 12 through line **41*a* to the flow control valve 14. If the control spool 42 is of a parallel flow type equipped with edge 46, shown in dotted line, the flow control valve 14 will be permanently connected to discharge of the pump 12, irrespective of the position of the control spool 42**.

Assume that while constant standby pressure condition is maintained in discharge line 38 the valve spool 20 is initially displaced from left to right cutting off by groove 70 the unloading chamber 30 from passage 69, signal passage 62 and positive load sensing ports 60 and 61. Further movement to the right of valve spool 20, through displacement of lands 22 and 21 will connect load chamber 26 with the positive load sensing port 60 and the load chamber 27 with the negative load sensing port 79, while lands 23, 22 and 21 still block communication between the supply chamber 25, load chambers 26 and 27 and outlet chambers 28 and 29. Assume also that actuator 11 is subjected to a positive load. Load pressure transmitted from actuator 11 through the positive load sensing port 60, signal passage 62, annular groove 55 and line 63, in a well known manner, will open check valve 64, close check valve 67 and reacting through line 65 on the differential pressure relief valve 16 increase pressure in discharge line 38 to maintain a constant pressure differential between pump pressure in discharge line 38 and load pressure in line 65. Load pressure from positive load sensing port 60 will also be transmitted through line 98 to the interlock 83. Since space 99 is connected through line **82*a*, passage 82 and negative load sensing port 79 to the low pressure zone in load chamber 27, activated by the pressure differential, piston 96 will move all the way from left to right, isolating line 95 and therefore space 91 from line 82*a* connected to passage 82 communicating with negative load sensing ports 79 and 78. As long as line 95 remains blocked, leakage orifice 93 maintains the space 91 at exhaust pressure level, with the brake spool 33 maintained by the brake spring 92 in its open inactive position with outlet chamber 29 connected through passages 31 to the exhaust chamber 34**.

Assume that from the position, in which load chamber 26 is connected to the positive load sensing port 60 and the load chamber 27 is connected to the negative load sensing port 79, the valve spool 20 is further displaced to the right, connecting the load chamber 26 with supply chamber 25 while the load chamber 27 is still isolated by land 21 from the outlet chamber 29. The pressure in the load chamber 26 will begin to rise, this change being transmitted through positive load sensing port 60, in a manner as previously described, to the differential pressure relief valve 16 proportionally increasing the pressure in discharge line 38. This increase in positive load pressure, in a well known manner, will be transmitted to the outlet side of actuator 11 proportionally increasing the pressure in the load chamber 27. The pressure signal from the load chamber 27 will be transmitted through the negative load sensing port 79 and passages 80 and 81 to the reaction chamber 49 where, acting on the effective area of land 47, it will generate a force opposing biasing force of the control spring 59 and the force generated on cross-sectional area of stem 50 by the positive load pressure contained in the control chamber 53. At a certain predetermined pressure level in the load chamber 27 the control spool 42 will move into a modulating position, regulating through cut off edge 44 the fluid flow between the inlet chamber 39 and the supply chamber 25 and the load chamber 26 to maintain load chamber 27 at a constant pressure level while maintaining the system leakage.

Further displacement of the valve spool 20 to the right will connect the load chamber 27 through metering slots 21*a* with the outlet chamber 29. Since, as previously described, load chamber 27 is maintained by spool 42 at a constant pressure level, irrespective of the variation in pressure in the load chamber 26 since the outlet chamber 29 is also maintained at a constant lower pressure level by exhaust relief valve 36, the flow from the load chamber 27 to the outlet chamber 29 will be proportional to the area of opening of the metering slots 21*a*. Since the pressure level in the load chamber 27 is maintained constant irrespective of the magnitude of load L and since also pressure in outlet chamber 29 is maintained constant, flow from actuator 11 will be proportional to the area of opening through metering slots 21*a* which in turn is proportional to displacement of valve spool 20. Therefore when controlling positive load, flow out of the actuator 11 is maintained at a constant level for each specific position of valve spool 20 irrespective of the variation in the load L.

Assume that the valve spools of flow control valves 10 and 14 were simultaneously actuated to a position at which fluid flow is delivered to actuators 11 and 15. Assume also that load W is higher than load L. In a well known manner, the higher of the load pressures will be transmitted through the check valve system in the load sensing circuit, the differential pressure relief valve 16 always responding to the highest system load pressure. High pressure due to load W, transmitted from the inlet chamber 39 to the supply chamber 25 and the load chamber 26, will tend to increase pressure in the load chamber 27 above its constant controlled level. This increase in pressure, in a manner as previously described, will be transmitted to the reaction chamber 49 and will bring control spool 42 into a new modulating position, in which cut off edge 44 will throttle the fluid flow from inlet chamber 39 to the supply chamber 25 to maintain the load chamber 27 at a constant controlled pressure level. Therefore irrespective of the variation in load L or W, or in variation in the pump discharge pressure during control of positive load, the control spool 42 will maintain the load chamber 27 at a constant pressure level, thus maintaining the flow control feature of the flow control valve 10. In a similar way the flow control feature of the flow control valve 14 will be maintained, this flow control feature being retained during simultaneous operation of the control valves 10 and 14.

Assume that during simultaneous control of loads L and W by flow control valves 10 and 14, load L becomes the higher of the two. Assume also that the combined flow demand of the flow control valves 10 and 14 will exceed the capacity of the fixed displacement pump 12. Pump pressure in discharge line 38 will start dropping below the level of the constant pressure differential maintained by the differential pressure relief valve 16 and therefore the differences between pressure due to load L and pressure in the discharge line 38 will decrease. As a result the force equilibrium acting on the control spool 42 will be disturbed. The control spool 42 under action of force developed on the cross-sectional area of stem 50, by pressure in the control chamber 53, will move from left to right moving cut off edge 44 out of its throttling position and throttling with throttling edge 45 fluid flow from the inlet chamber 39 to the bypass chamber 41, thus throttling fluid flow supplied to flow control valve 14. In this way flow control spool 42, by throttling action of the throttling edge 45, will maintain the load chamber 27 at a constant controlled pressure level, this constant controlled pressure level being maintained by regulating the bypass flow to actuator 15. Due to this bypass throttling action the flow control valve 10 has a priority feature, which permits proportional control of load L, when the combined flow demand of flow control valves 10 and 14 exceeds the flow capacity of the fixed displacement pump 12. If during simultaneous control of loads L and W, load W is the higher of the two and when flow demand of flow control valves 10 and 14 exceeds the capacity of the fixed displacement pump 12, the system pressure will drop to a level, equivalent to the load pressure L, at which time, in a manner as previously described, the control spool 42 will regulate, by throttling with the throttling edge 45, the bypass flow from the inlet chamber 39 to the bypass chamber 41, to maintain a constant pressure level in the load chamber 27. Therefore irrespective of the variation in the magnitude of the loads L and W, during simultaneous operation of flow control valves 10 and 14, once the combined flow demand of the flow control valves exceeds the capacity of the fixed displacement pump 12, the flow control valve 10 always retains the priority feature. With the flow control spool 42 of parallel flow type having edge 46, as shown by dotted line, the priority feature of the flow control valve 10 is lost, the flow control valves 10 and 14 working in a parallel circuit.

Assume that while constant standby pressure condition is maintained in discharge line 38, the valve spool 20 is initially displaced from left to right cutting off by groove 70 the unloading chamber 30 from passage 69, signal passage 62 and positive load sensing ports 60 and 61. Further movement to the right of valve spool 20, through displacement of lands 22 and 21 will connect the load chamber 26 with the positive load sensing port 60 and the load chamber 27 with the negative load sensing port 79, while lands 23, 22 and 21 still block communication between the supply chamber 25, the load chambers 26 and 27 and outlet chambers 28 and 29. Assume also that actuator 11 is subjected to a negative load. Since the load chamber 26 is subjected to minimum pressure, the pressure signal transmitted through the positive load sensing port 60 will not change the setting of the differential pressure relief valve 16, the pump 12 maintaining discharge line 38 at minimum pressure level. The negative load pressure signal from the load chamber 27 will be transmitted through the negative load sensing port 79 and passages 80 and 81 to the reaction chamber 49, where reacting on the effective cross-sectional area of land 47 it will move control spool 42 all the way from right to left, compressing control spring 59 and isolating with cut off edge 44 the supply chamber 25 from the inlet chamber 39. Negative load pressure from the load chamber 27, transmitted through the negative load sensing port 79, passage 82 and line **82*a* will move piston 96 of interlock 83 from right to left, opening the line 95 and connecting negative load pressure with space 91. Negative load pressure in space 91, acting on the cross-sectional area of brake spool 33, against biasing force of brake spring 92 will move the brake spool 33 from right to left, with cut off edges 90 isolating the outlet chamber 29 from the exhaust chamber 34. Also negative load pressure, transmitted from negative load sensing port 79 through passage 82, lines 82*a* and 84 will open check valve 85, close check valve 89 and transmitted through lines 86 and 87 to space 107 react on the cross-sectional area of the force piston 103, moving it upward against stops 105 and compressing spring 101. Higher biasing force of the spring 101, transmitted through the throttling member 100 to seat 102, in a well known manner, will increase pressure in the exhaust line 73. The increased exhaust pressure in line 73 will open bypass check valve 74 subjecting the supply chamber 25** to the increased exhaust pressure.

Further movement of valve spool 20 to the right will connect the supply chamber 25 to the load chamber 26 and also will connect the load chamber 27 through metering slots **21*a* with the outlet chamber 29. Rising pressure in outlet chamber 29, reacting on the cross-sectional area of brake spool 33 and biasing force of brake spring 92 will balance the force, developed on the cross-sectional area of brake spool 33 due to the negative load pressure in space 91 and bring brake valve spool 33 into a modulating position, in which the brake spool 33 by throttling action of cut off edge 90 will maintain a constant pressure differential across the metering orifice 21*a*. Therefore for each position of valve spool 20, corresponding to a specific area of metering orifice 21*a*, constant flow will take place from load chamber 27 to outlet chamber 29, irrespective of the variation in the magnitude of the negative load in the actuator 11. High pressure flow out of the actuator 11 during control of negative load will be replenished on the other side of the actuator from exhaust line 73, through bypass check valve 74 at an increased pressure level of exhaust relief valve 36, while utilizing a combined exhaust flow from the exhaust chamber 34 and the differential pressure relief valve 16. The exhaust fluid at increased pressure is supplied to the actuator inlet, during control of negative load, while the fixed displacement pump 12 is completely isolated by control spool 42 from the supply chamber 25 and the actuator 11. Therefore, since none of the potential pump delivery is used as actuator make-up fluid during control of negative load, higher pump capacity is made available for simultaneous control of multiple positive loads. During control of two negative loads, for example, loads L and W, through the well known action of the check valves 85 and 89, the higher of the two negative load signals is transmitted to the exhaust relief valve 36, the lower negative pressure zone being isolated by the second check valve, thus permitting proportional control of both negative loads. The exhaust circuit is also supplied by line 75 with exhaust fluid from flow control valve 14, the combined exhaust flow of both control valves and the bypass flow from the differential pressure relief valve 16** being available for the make-up flow to the system actuators controlling negative loads, while full pump capacity is being saved for operation of the other positive loads.

During control of positive load increased exhaust pressure created by exhaust relief valve 36 is detremental, since it decreases system efficiency and therefore it should be kept at a minimum level. During control of negative load this exhaust pressure, created by the exhaust pressure relief valve 36, should be comparatively high to provide actuator inlet flow requirement without cavitation. These two requirements are conflicting. By providing a special exhaust pressure relief valve 36, which automatically increases the exhaust pressure during control of negative loads, to provide cavitation free make-up fluid to the actuator and by unloading the exhaust pressure relief valve to a minimum pressure during operation of positive load, a very efficient high performance system with minimum loss is achieved.

Figure 2:
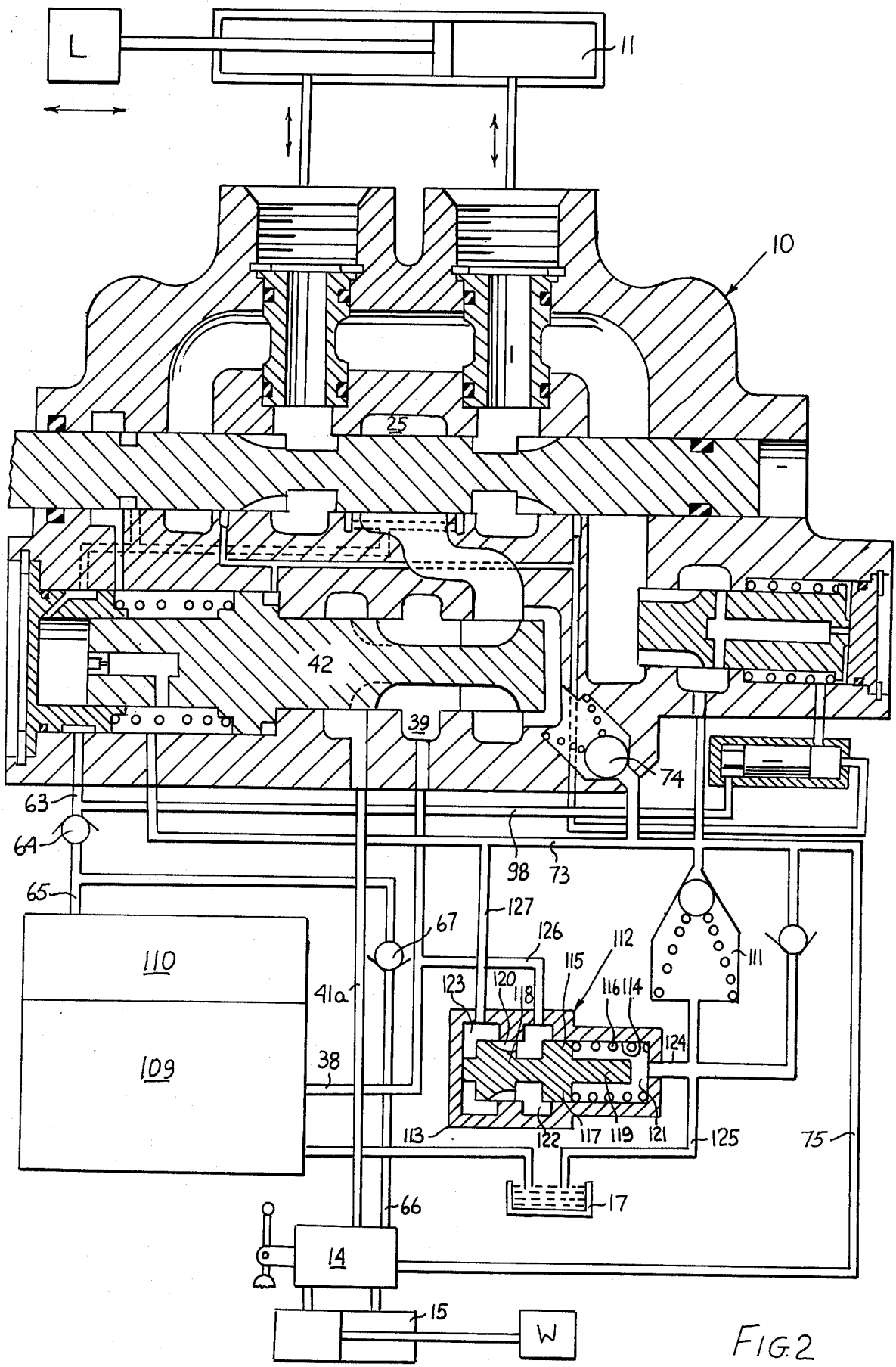
FIG. 2 is a sectional view of an embodiment of flow control valve of FIG. 1 used in load responsive fluid control system with lines, variable displacement pump equipped with differential pressure compensator, second load responsive valve, exhaust relief valve, exhaust pressure reducing valve, control interlock and system reservoir shown diagramatically.

Referring now to FIG. 2 flow control valves 10 and 14 are identical to those of FIG. 1 and perform their control functions in the same way. Load sensing circuits of flow control valves of FIGS. 1 and 2 with their check valve systems are again identical, the positive load pressure of the highest system load being transmitted to line 65. However, a pump 109 of FIG. 2 is of a variable displacement type and is controlled by a differential pressure compensator 110 which, in a well known manner, varies the displacement of the pump 109 to maintain discharge line 38 at a pressure, higher by a constant pressure differential, than the load signal pressure transmitted to the differential pressure compensator 110 from the load sensing circuit by line 65. Therefore in both systems, as shown in FIGS. 1 and 2, by control of pump flow delivered to discharge line 38, a constant pressure differential is maintained between pressure in discharge line 38 and pressure in line 65, in response to the highest system load being operated. Although the load control features of systems shown in FIGS. 1 and 2 are identical the amount of flow delivered to exhaust circuit and specifically to exhaust line 73 is different for each circuit. In FIG. 1 all of the excess pump flow is delivered by the differential pressure relief valve 16 through line 72 to exhaust line 73. Since pump 12 is of a fixed displacement type with system valve spool in neutral position all of the pump flow is directed by the differential pressure relief valve 16 to exhaust line 73. In FIG. 2 since pump 109 is of a variable displacement type, it supplies the exact amount of fluid to satisfy the system demand, none of the pump flow being normally diverted to exhaust line 73. Therefore in the arrangement of FIG. 2 less exhaust flow is available to satisfy inlet flow requirements of system actuators during control of negative loads. Normally an actuator, in the form of a cylinder, due to presence of piston rod displaces different flows from each cylinder port, per unit length displacement of its piston. Therefore while controlling a negative load the exhaust flow out of the cylinder might be substantially smaller than its inlet flow requirements. Under these conditions, since the communication between inlet chamber 39 and the supply chamber 25 is blocked by control spool 42, exhaust pressure level, as maintained by exhaust pressure relief valve 111 will drop below atmospheric pressure, exhaust pressure relief valve will close entirely and cavitation will take place at the inlet side of the cylinder. To prevent cavitation and to maintain exhaust line 73 at a minimum pressure level a pressure reducing valve, generally designated as 112, is provided. Pressure reducing valve 112 has a valve housing 113 provided with a valve bore 114, axially guiding a valve spool 115 which is biased towards position as shown in FIG. 2 by a spring 116. The valve spool 115 is provided with lands 117 and 118, stop 119 and throttling slots 120. Valve housing 113 is provided with space 121 and chambers 122 and 123. Space 121 is connected through lines 124 and 125 with the system reservoir 17. The chamber 122 is connected by line 126 with discharge line 38 which is supplied with fluid under pressure from the pump 109. The chamber 123 is connected by line 127 with exhaust line 73. Fluid under pressure is supplied from pump 109, discharge line 38 and line 126 to the chamber 122 and through throttling slots 120 to the chamber 123, which is connected by line 127 with exhaust line 73. Pressure in the chamber 123 and in the exhaust system will begin to rise and reacting on the cross-sectional area of valve spool 115 will tend to move it from left to right, compressing the spring 116 and closing the connection through throttling slots 120 between chambers 123 and 122. In this way pressure reducing valve 112, in a well known manner, will throttle fluid flow from chamber 122 to chamber 123 and therefore to exhaust line 73, to maintain exhaust line 73 at a constant pressure, as dictated by the preload in the spring 116. This constant controlled pressure level is selected below controlled pressure level of the exhaust pressure relief valve 111. As long as the exhaust pressure relief valve 111 maintains the exhaust system at its controlled pressure level, communication between chambers 123 and 122 of the pressure reducing valve 112, will be closed and no flow from the pump 109 will be diverted into the exhaust circuit to maintain it at a minimum constant pressure level, Once, however, during control of negative load the actuator inlet flow requirement would exceed the actuator outlet flow, the exhaust pressure relief valve 111 will close, pressure in the exhaust system will drop to the control pressure setting of the pressure reducing valve 112 and the motor exhaust flow will be supplemented from the pump circuit by the pressure reducing valve 112, to maintain the actuator inlet at the required pressure. Therefore during control of negative load only the difference between the actuator inlet flow requirement and the actuator exhaust flow will be supplied to the exhaust circuit from the variable displacement pump 109. This feature not only improves the efficiency of the system but greatly extends the capacity of the variable displacement pump to perform useful work in control of positive loads.

The differential pressure compensator 110 may be, in a conventional way, mounted directly on the variable displacement pump 109 or can be made a part of the valve assembly. If the differential pressure compensator 110 is made part of the valve assembly it is connected to the variable displacement pump 109 by three lines, one line at pump discharge pressure, one line at reservoir pressure and one line for conducting of modulated control signal to the displacement changing mechanism of the variable displacement pump 109.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. Multiple load responsive valve assemblies each comprising a housing having a fluid inlet chamber connected to pump means, a fluid supply chamber, first and second load chambers, outlet fluid conducting means and fluid exhaust means connected to reservoir means, first valve means for selectively interconnecting said fluid load chambers with said fluid supply chamber and said fluid exhaust means, said first valve means having variable metering orifice means operable to throttle fluid flow between said load chambers and said fluid exhaust means, pressure sensing means selectively communicable with said load chambers by said first valve means, second valve means interconnecting said fluid inlet chamber and said fluid supply chamber, said second valve means having means responsive to pressure upstream of said variable orifice means and means responsive to pressure in said fluid supply chamber and operable to maintain said pressure upstream of said variable orifice means at a relatively constant predetermined level when said fluid supply chamber is connected to one of said load chambers by said first valve means and said load camber is pressurized, said second valve means having isolating means to isolate said fluid supply chamber from said fluid inlet chamber when said fluid supply chamber is connected to one of said load chambers by said first valve means and said load chamber is not pressurized, fluid replenishing means to connect said supply chamber with said exhaust means when said isolating means isolates said fluid supply chamber from said inlet chamber, and control means connected to said inlet chambers of said valve assemblies, control line means interconnecting said control means with said pressure sensing means of said valve assemblies, check valve means in each of said control line means, said control means responsive to highest pressure in any of said load chambers of valve assemblies operating loads and operable to vary fluid flow delivered from said pump means to said load system to maintain a constant pressure differential between pressure in said inlet chambers and said maximum pressure in said load chamber.

2. Multiple load responsive valve assemblies as set forth in claim 1 wherein fourth valve means interconnects said load chambers and said fluid exhaust means, said fourth valve means responsive to pressure differential across said variable metering orifice means and operable to maintain said pressure differential constant when one of said load chambers is connected through said variable metering orifice means to said fluid exhaust means by said first valve means and said load chamber is pressurized.

3. Multiple load responsive valve assemblies as set forth in claim 2 wherein said housings of said multiple valve assemblies have deactivating means to deactivate said fourth valve means when said supply chamber is connected to one of said load chambers and said load chamber is pressurized.

4. Multiple load responsive valve assemblies as set forth in claim 3 wherein said deactivating means are responsive to pressure in said pressure sensing port means and to pressure upstream of said variable metering orifice means.

5. Multiple load responsive valve assemblies as set forth in claim 1 wherein said first valve means includes a valve spool axially guided in a valve bore and movable from a neutral position to at last two actuated positions, said valve spool isolating said load chambers from said supply chamber and said fluid exhaust means when in neutral position and when displaced from neutral position first uncovering a control signal passage means in the region of said spool bore between one of said load chambers and said fluid supply chamber.

6. Mutliple load responsive valve assemblies as set forth in claim 1 wherein said housings of said multiple valve assemblies have a fluid bypass chamber adjacent to said fluid inlet chamber, said second valve means selectively interconnecting said fluid inlet chamber, said fluid supply chamber and said fluid bypass chamber, said second valve means having throttling means between said fluid inlet chamber and said fluid supply chamber and priority control means between said fluid inlet chamber and said fluid bypass chamber, said second valve means responsive to pressure upstream of said variable orifice means in said fluid conducting means and operable to maintain said pressure at a relatively constant predetermined level by said throttling means or said priority control means when said fluid supply chamber is connected to one of said load chambers by said first valve means and said load chamber is pressurized.

7. Multiple load responsive valve assemblies as set forth in claim 6 wherein said second valve means has sequencing means to interconnect said fluid inlet chamber and said fluid bypass chamber while said first valve means is in neutral position isolating said load chambers from said supply chamber, said outlet fluid conducting means, said fluid exhaust means and said pressure sensing port means.

8. Multiple load responsive valve assemblies as set forth in claim 1 wherein said control means has pump displacement changing control means to vary fluid flow delivered from said pump means to said valve assemblies.

9. Multiple load responsive valve assemblies as set forth in claim 1 wherein duct means interconnect said fluid exhaust means of said valve assemblies with said reservoir means.

10. Multiple load responsive valve assemblies as set forth in claim 9 wherein exhaust pressure relief valve means in said duct means is interposed between said valve assemblies and said reservoir means.

11. Mulitple load responsive valve assemblies as set forth in claim 10 wherein check valve means interconnect for one way fluid flow said duct means upstream of said exhaust pressure relief valve means and said fluid supply chamber of each of said valve assemblies.

12. Multiple load responsive valve assemblies as set forth in claim 10 wherein constant pressure reducing valve means interconnects said inlet chambers of said valve assemblies and said duct means upstream of said exhaust pressure relief valve means and operable to maintain said duct means upstream of said exhaust pressure relief valve means at a constant pressure level lower than pressure setting of said exhaust pressure relief valve means when said exhaust pressure relief valve means stop passing fluid from said valve assemblies to said reservoir means.

13. A load responsive valve assembly as set forth in claim 1 wherein said housing has a fluid outlet chamber interposed between said load chambers and said fluid exhaust means, said variable metering orifice means selectively interconnecting one of said load chambers with said outlet chamber.

14. A valve assembly supplied with pressure fluid by a pump, said valve assembly comprising a housing having a fluid inlet chamber, a fluid supply chamber, first and second load chambers, outlet fluid conducting means, exhaust means connected to reservoir means and load pressure sensing means operable to transmit a control signal to control means operable to vary flow delivered from said pump to said inlet chamber, first valve means for selectively interconnecting said fluid load chambers with said fluid supply chamber, said fluid exhaust means and said load pressure sensing means, said first valve means having variable metering orifice means operable to throttle fluid flow between said load chambers and said fluid exhaust means, second valve means interconnecting said fluid inlet chamber and said fluid supply chamber, said second valve means having means responsive to pressure upstream of said variable orifice means and means responsive to pressure in said fluid supply chamber and operable to maintain said pressure upstream of said variable orifice means at a relatively constant predetermined level when said fluid supply chamber is connected to one of said load chambers by said first valve means and said load chamber is pressurized, said second valve means having isolating means to isolate said fluid supply chamber from said fluid inlet chamber when said fluid supply chamber is connected to one of said load chambers by said first valve means and said load chamber is not pressurized and fluid replenishing means to connect said supply chamber with said exhaust means when said isolating means isolates said fluid supply chamber from said inlet chamber.

* * * * *